United States Patent [19]

Chass

[11] 4,445,103

[45] Apr. 24, 1984

[54] ROTARY DIFFERENTIAL TRANSFORMER WITH CONSTANT AMPLITUDE AND VARIABLE PHASE OUTPUT

[75] Inventor: Jacob Chass, Rego Park, N.Y.

[73] Assignee: Pickering & Company, Inc., Plainview, N.Y.

[21] Appl. No.: 522,050

[22] Filed: Aug. 10, 1983

[51] Int. Cl.[3] ..... H01F 21/06

[52] U.S. Cl. ..... 336/135; 336/130; 336/131; 336/132; 336/134; 323/348

[58] Field of Search ..... 323/347, 348; 336/130, 336/131, 132, 134, 135

[56] References Cited

U.S. PATENT DOCUMENTS 3,030,595 5/1962 Campbell et al. ..... 336/134 X 3,281,655 10/1966 Blasingame ..... 336/135 X 3,641,467 2/1972 Ringland et al. ..... 336/135 X 3,882,436 5/1975 Chass ..... 336/130 X

*Primary Examiner*—J. V. Truhe

*Assistant Examiner*—Susan Steward

*Attorney, Agent, or Firm*—Kane, Dalsimer, Kane, Sullivan and Kurucz

[57] ABSTRACT

A rotary differential transformer is provided which has a constant amplitude output the phase angle of which varies with the angular displacement of a rotor. The rotor contains a pair of core segments of magnetic material which serve to couple portions of first and second primary coils to a secondary coil. The primary coils are connected to AC sources 90° out of phase with each other.

8 Claims, 9 Drawing Figures

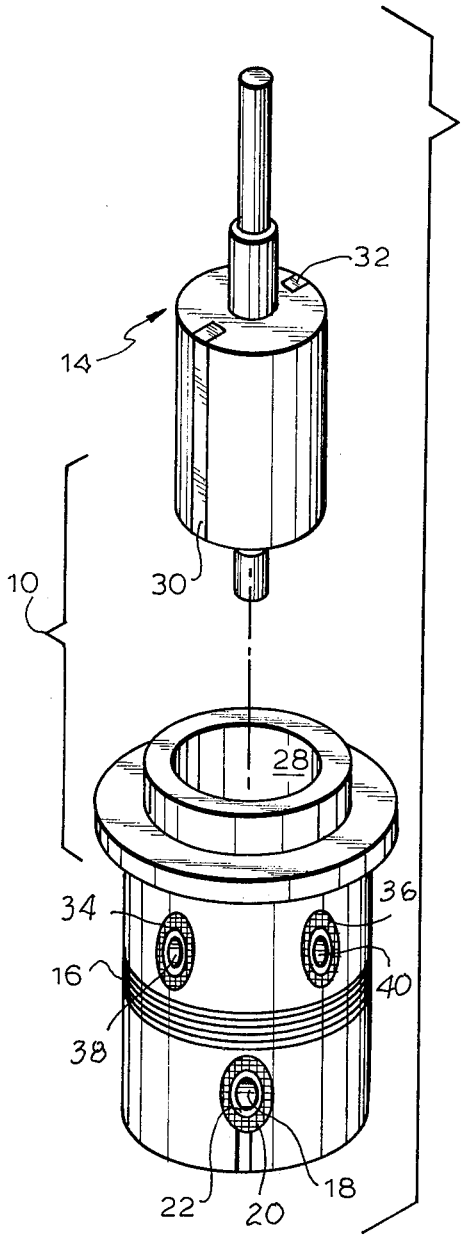
FIG.1
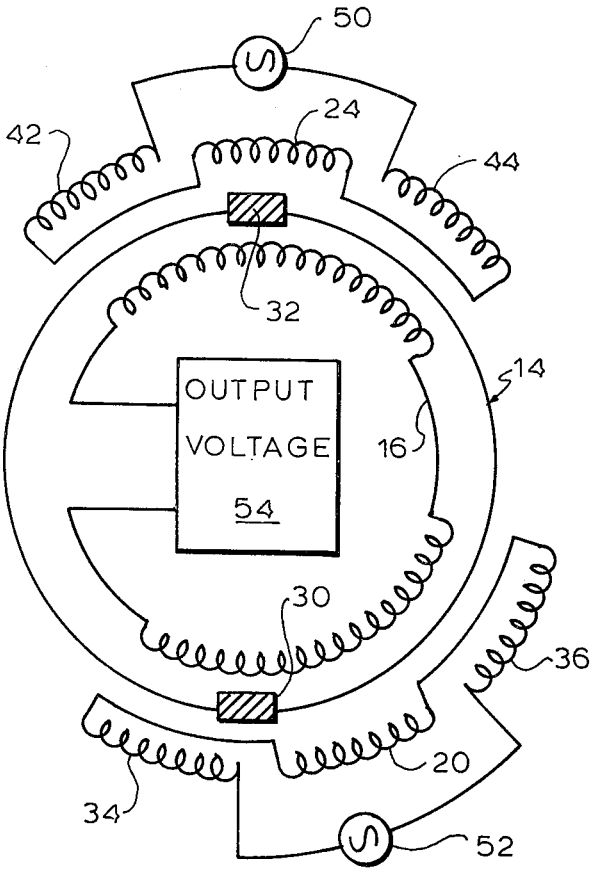
FIG.2
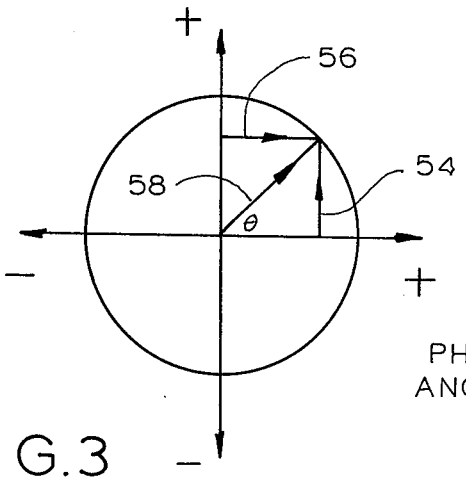
FIG.3
FIG.4
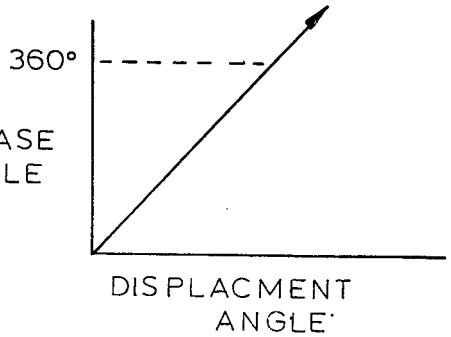

FIG.8
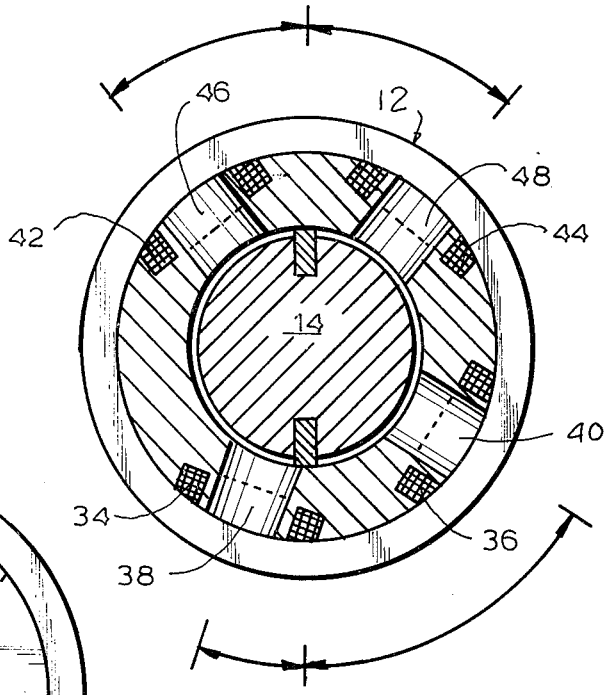
FIG.7
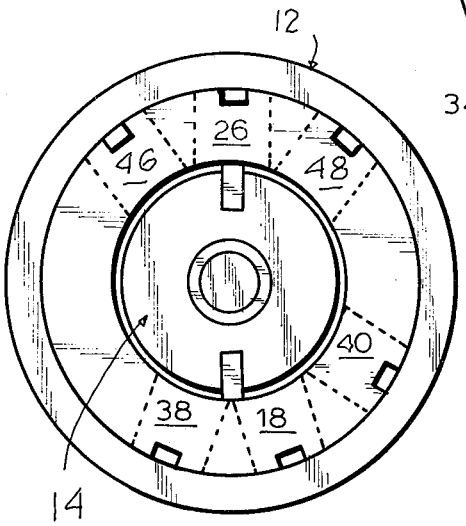
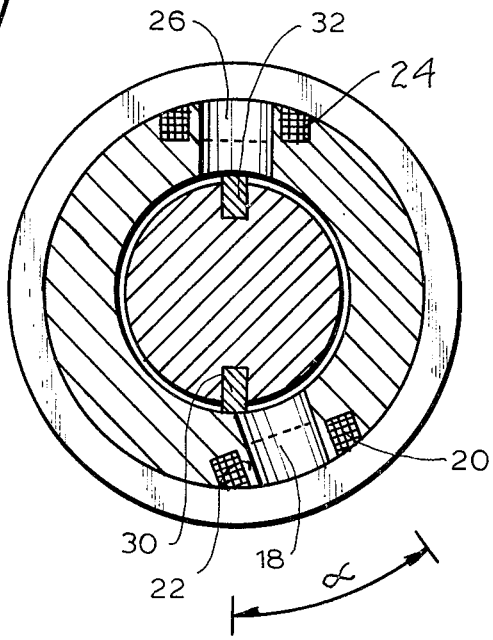
FIG.9

ROTARY DIFFERENTIAL TRANSFORMER WITH CONSTANT AMPLITUDE AND VARIABLE PHASE OUTPUT

BRIEF DESCRIPTION OF THE INVENTION

The present invention relates generally to angular displacement detecting transducers and more particularly to such a transducer wherein the output signal varies in phase substantially linearly with respect to angular displacement.

It has heretofore been proposed to provide a transducer which produces an output signal which varies in response to the angular displacement of a sensing element. In U.S. Pat. No. 3,551,866, a variable differential transformer (RVDT) is disclosed wherein the amplitude of the output signal is a function of the angular displacement of a movable core with respect to fixed primary and secondary coils. While this type of device has the advantage of relative ease of manufacture and assembly, there are some applications in which a relatively constant amplitude output signal may be desirable or mandatory regardless of the angular displacement.

In view of the above, it is a principal object of the present invention to provide an improved transformer having an output signal which is constant in amplitude and variable in phase with respect to angular displacement of its sensing element.

A further object is to provide such a transformer in which the phase of the output signal varies generally linearly with angular displacement of the sensing element.

A still further object of the present invention is to provide such a transformer wherein the accuracy of the output signal is constant over the transformer operating range.

A still further object is to provide such a transformer which is readily easy to manufacture and assemble.

Still other objects and advantages will be apparent from the following description of the present invention.

SUMMARY OF THE INVENTION

The above and other beneficial objects and advantages are attained in accordance with the present invention by providing a differential transformer comprising a cylindrical bobbin of non-magnetic material having a transformer secondary winding extending circumferentially thereabout. Transformer first and second primary windings extend about radii of said cylinder generally transverse to the secondary winding.

A non-magnetic rotor is disposed for rotation within the bobbin. First and second core segments of magnetic material are provided on the rotor. The core segments are disposed to magnetically couple portions of the primary winding to the secondary, the portions being determined by the angular displacement of the rotor, so that when the primary windings are excited by voltage sources 90° out of phase with each other the phase of the secondary winding output voltage will be a function of the angular displacement of the core.

BRIEF DESCRIPTION OF THE DRAWINGS

In the accompanying drawings:

FIG. 1 is an exploded perspective view of a differential transformer in accordance with the present invention (with its magnetic shielding removed);

FIG. 2 is a schematic view of the differential transformer of FIG. 1;

FIG. 3 depicts the phase relationship of the output voltage of transformer of the present invention;

FIG. 4 depicts the relationship between the angular displacement of the transformer core and the phase angle of the output voltage;

FIG. 7 is a bottom plan view of the transformer of FIG. 5.

FIG. 8 is a sectional view of the transformer of FIG. 5 in the direction indicated by the arrows; and, FIG. 9 is a sectional view taken along reference lines 9—9 of FIG. 5 in the direction indicated by the arrows.

DETAILED DESCRIPTION OF THE PREFERRED EMBODIMENT

Figure 5:
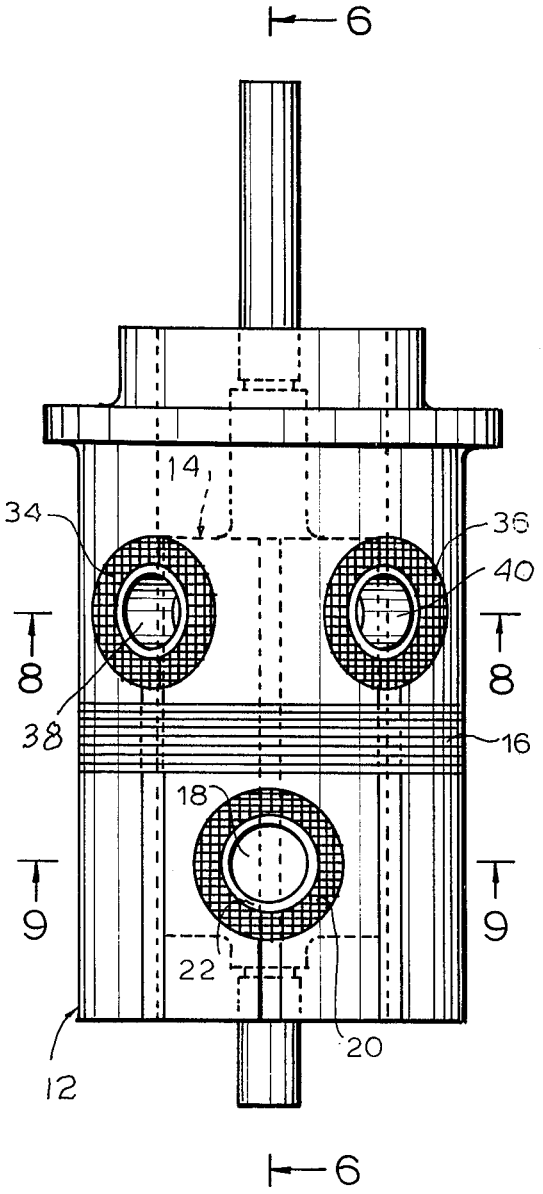
FIG. 5 is an elevational view of the transformer of FIG. 1 shown in assembled form.

Reference is now made to the drawings and in particular to FIG. 1 wherein a transformer 10 in accordance with the present invention is shown comprising a bobbin 12 and rotor 14. The assembled transformer is packaged in a casing (not shown) which provides magnetic coupling, and also shielding for the magnetic circuit of the transformer. Both the bobbin 12 and rotor are formed of suitable non-magnetic materials such as non-magnetic stainless steel.

The bobbin 12 includes a central slot that extends circumferentially and about which a coil 16 defining a secondary winding is wound. A bore 18 extends radially along a radius of bobbin 12 and a coil 20 defining a first primary winding wound about a magnetic pole piece 22 which is positioned within bore 18. Thus, primary winding 20 is generally transverse to the secondary winding (i.e., it defines a plane that is parallel to the axis of bobbin 12). A similar coil 24 is wound around a magnetic piece which is positioned in a bore 26 on the opposite side of the bobbin. Bore 26 is diametrically opposite bore 18 offset by the radius of a pole-piece such as pole piece 22. Coil 24 defines a second primary winding for the transformer.

Figure 6:
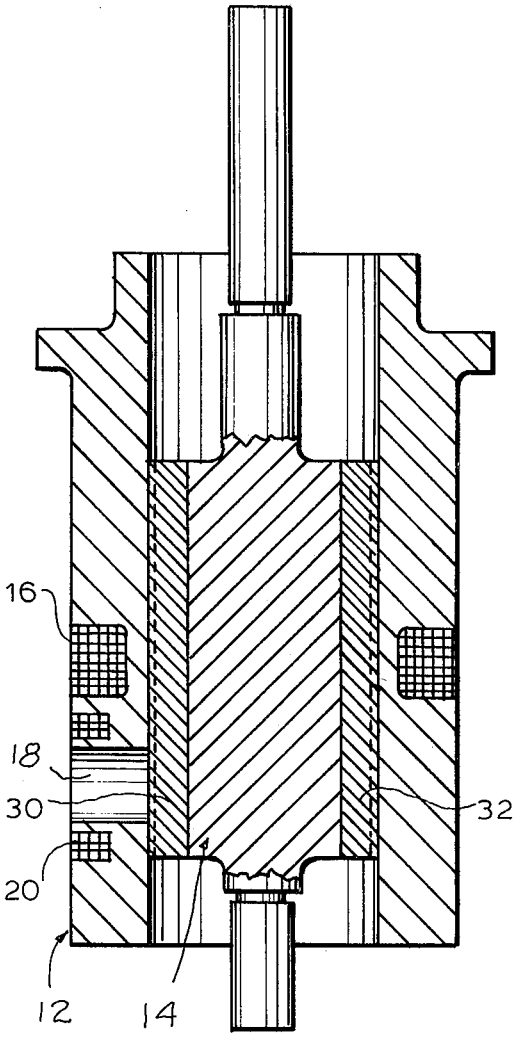
FIG. 6 is a sectional view taken along reference lines 6—6 of FIG. 5 in the direction indicated by the arrows.

Rotor 14 is designed to fit within a longitudinal bore 28 extending through bobbin 12. The rotor is formed of a non-magnetic material such as stainless steel and is supported for rotation by suitable bearings (not shown). A pair of slots extend longitudinally along diametrically opposed surfaces of the rotor and core segments 30 and 32 are positioned in the slots. The core segments are formed of a magnetic material such as Permaloy. As can be seen in FIGS. 5 and 6, each of the core segments serve to magnetically couple a portion of a pole piece to the secondary coil.

A pair of additional primary coils 34 and 36 are provided in radial bores 38 and 40 positioned so that coils 34 and 36 are immediately adjacent opposite sides of coil 20. Similarly, an additional pair of coils 42 and 44 are provided around radial bores containing magnetic pole pieces 46 and 48 positioned so that coils 42 and 44 are immediately adjacent opposite sides of coil 24. Coils 34 and 36 are connected in bucking series to coil 20. Coils 42 and 44 are connected in bucking series to coil 24. Each of the primary winding coils (i.e., coils 20, 34, 36, 24, 42 and 44) contain the same number of turns of the same wire and are of the same radius. Coils 24, 42, 44 are connected to a first AC source 50. Coils 20, 34, 36 are connected to a second AC source 52 which is equal to but 90° out of phase with source 50.

When the primary coils are excited by the AC sources 50 and 52 the output voltage 54 of the transformer secondary will remain constant regardless of the position of the rotor although the phase angle of the output voltage will vary as a function of the angular displacement of the rotor. The operating range (i.e., the angular displacement $\theta$ over which the transformer will operate is determined by the diameter of the magnetic pole and the number of coils in each set.

The operation of the transformer is as follows. When a circle is intersected by a pair of parallel lines, the area of the circle intersected varies sinusoidally as the lines traverse along a diameter of the circle perpendicular to the lines. Since the flux line distribution of a coil is generally circular, as the rotor is rotated past primary winding 20, the core segment 30 will couple flux from the primary winding 20 to the secondary winding which varies sinusoidally from zero to a maximum to zero. If rotation is continued the flux will then be coupled from coil 34 or 36 (depending on the direction of rotation) to the secondary winding. However, since both coils are connected to coil 20 in bucking series, the coupled flux from the adjacent coils will then vary sinusoidally from zero to a minimum to zero. On the opposite side of the transformer, core segment 32 is coupling flux from coil 24 (or 42 or 44) to the secondary winding. However, since primary coils 24, 42 and 44 are offset from being directly opposite coils 20, 36 and 34 by the radius of the magnetic pole, the flux coupled by core segment 32 lags or leads the flux coupled by core segment 30. Thus, when the flux coupled by core segment 30 maximizes the flux coupled by core segment 32 minimizes and vice versa. The total flux induced in the secondary winding is the vector sum of the flux coupled by the two core segments 30 and 32. Since the primary coils coupled by core segments 30 and 32 are excited by AC voltages 90° out of phase with each other, they will be produce sine and cosine components of a vector at a phase angle $\theta$ and at a constant amplitude. As a result, the phase angle $\theta$, of the output of the transformer will be a function of the angular displacement of rotor 16 but the amplitude will remain constant.

The operating range of the transformer may be increased by adding additional primary winding in series bucking relationship to the coil groupings 20, 34, 36 and 24, 42, 44. Such additional coils would have to be positioned so that they are circumferentially adjacent the last previous coils although the coils may be longitudinally offset as shown. The relationship between the diameter of the bobbin to the diameter of the magnetic poles determines the relationship between the displacement angle of the rotor and the phase angle of the output signal since the arc that the rotor must swing through to completely pass over two adjacent poles determines the displacement angle that can be detected in 360° of phase shift of the transformer output.

Thus, in accordance with the above, the aforementioned objects are effectively attained.

Having thus described the invention, what is claimed is:

1. A differential transformer comprising:

(a) a cylindrical bobbin;

(b) a transformer secondary winding comprising a coil extending circumferentially about a segment of said bobbin;

(c) a non-magnetic rotor disposed within and coaxial with said bobbin;

(d) first and second magnet pole pieces extending along radii of said bobbin cylinder;

(e) transformer first and second primary windings disposed respective about said pole pieces;

(f) first and second magnetic core segments of said rotor, each of said core segments being disposed to couple a portion of one of said primary windings to said secondary winding whereby when said primary windings are excited by AC voltage sources 90° out of phase with each other the phase of the secondary winding output voltage will vary with the angular displacement of said rotor.

2. The transformer in accordance with claim 1 wherein said primary windings have equal number of turns and are of equal radius.

3. The transformer in accordance with claim 2 wherein said first and second primary windings are angularly offset from one another.

4. The transformer in accordance with claim 3 wherein said core segments are angularly offset from one another.

5. The transformer in accordance with claim 4 wherein said core segments are offset from one another by 180°.

6. The transformer in accordance with claim 5 wherein said primary windings are offset by one another by 180° + the radius of a magnetic pole.

7. The transformer in accordance with claim 2 comprising:

(a) third and fourth primary windings connected in bucking series to said first primary winding and disposed adjacent said first primary winding circumferentially about said cylinder; and, (b) fifth and sixth primary windings connected in bucking series to said second primary winding and disposed adjacent said second primary winding circumferentially about said cylinder.

8. The transformer in accordance with claim 7 wherein said third and forth primary windings are longitudinally offset from said first primary winding and said fifth and sixth primary windings are offset from said second primary winding.

* * * * *